US011602162B2

(12) United States Patent
LeNoir et al.

(10) Patent No.: US 11,602,162 B2
(45) Date of Patent: Mar. 14, 2023

(54) WATER PIPE

(71) Applicant: Session Corp., San Francisco, CA (US)

(72) Inventors: Esther Joy LeNoir, San Francisco, CA (US); Vinh Do Pho, San Francisco, CA (US); Camden Lee Foley, San Francisco, CA (US); Samuel Timothy Davis Bertain, San Francisco, CA (US)

(73) Assignee: Session Corp., San Francisco, CA (US)

( * ) Notice: Subject to any disclaimer, the term of this patent is extended or adjusted under 35 U.S.C. 154(b) by 517 days.

(21) Appl. No.: 16/589,930

(22) Filed: Oct. 1, 2019

(65) Prior Publication Data

US 2020/0315246 A1 Oct. 8, 2020

Related U.S. Application Data

(60) Provisional application No. 62/828,886, filed on Apr. 3, 2019.

(51) Int. Cl.

| | |
|---|---|
| ***A24F 1/30*** | (2006.01) |
| ***A24F 1/32*** | (2006.01) |
| ***A24F 5/00*** | (2006.01) |

(52) U.S. Cl.

CPC ..... *A24F 1/30* (2013.01); *A24F 1/32* (2013.01); *A24F 5/00* (2013.01)

(58) Field of Classification Search

USPC ..... 131/173; D27/162

See application file for complete search history.

(56) References Cited

U.S. PATENT DOCUMENTS

| | | | | |
|---|---|---|---|---|
| D139,381 | S | 11/1944 | Harris | |
| 2,831,596 | A * | 4/1958 | Eyles | A61J 11/008 215/11.1 |
| D189,373 | S | 11/1960 | Lerner | |
| D203,008 | S | 11/1965 | Ota | |
| 3,289,897 | A | 12/1966 | Ginsberg | |
| D223,438 | S | 4/1972 | Lluch | |
| D237,863 | S | 12/1975 | Peters | |
| D244,531 | S | 5/1977 | Klingaman | |
| 4,031,904 | A * | 6/1977 | Karl | A24F 1/30 131/173 |

(Continued)

FOREIGN PATENT DOCUMENTS

WO WO2018/171932 * 9/2018

OTHER PUBLICATIONS

Martyn Cornell, "More notes towards a history of the beer mug", ZYTHOPHILE, https://zythophile.co.uk/2015/03/28/more-notes-towards-a-history-of-the-beer-mug/, Mar. 28, 2015, printed from the Internet on Dec. 10, 2021. (Year: 2015).*

(Continued)

*Primary Examiner* — Michael H. Wilson
*Assistant Examiner* — Dionne W. Mayes
(74) *Attorney, Agent, or Firm* — Duane Morris LLP; Gregory M. Lefkowitz; Wei-Sern Cheah

(57) ABSTRACT

According to some examples, a water pipe can include a body with a top end section, a bottom end section and an opening at the top end section. The opening can be angled with respect to a vertical axis. Additionally, the body of the water pip can include a well extending from the opening to the bottom end section, and an indent extending from the top end section to the bottom end section.

20 Claims, 8 Drawing Sheets

(56) References Cited

U.S. PATENT DOCUMENTS

| | | | | |
|---|---|---|---|---|
| 4,198,993 | A * | 4/1980 | Martin et al. | A24F 1/30 131/173 |
| D305,193 | S | 12/1989 | Sajadieh | |
| D359,369 | S | 6/1995 | Caplette | |
| D373,730 | S | 9/1996 | Baron | |
| 5,967,147 | A * | 10/1999 | Newman | A24F 1/30 131/180 |
| D420,448 | S | 2/2000 | Brown | |
| D423,107 | S | 4/2000 | Brown | |
| D440,157 | S | 4/2001 | Lichtman | |
| D460,696 | S | 7/2002 | Goettner | |
| D462,270 | S | 9/2002 | Renz | |
| D462,615 | S | 9/2002 | Weil | |
| D463,262 | S | 9/2002 | Gobe | |
| D463,734 | S | 10/2002 | Gobe | |
| D463,756 | S | 10/2002 | Vea | |
| D475,927 | S | 6/2003 | Maddy | |
| D480,272 | S | 10/2003 | Yang | |
| D486,394 | S | 2/2004 | Bakic | |
| D495,186 | S | 8/2004 | Poupel | |
| D497,441 | S | 10/2004 | Therrien | |
| D522,866 | S | 6/2006 | Bakic | |
| D563,222 | S | 3/2008 | Yamanaka | |
| D567,009 | S | 4/2008 | Bodum | |
| D582,063 | S | 12/2008 | Spangler | |
| D597,598 | S | 8/2009 | Ma | |
| D605,953 | S | 12/2009 | Wang Treadway | |
| D620,756 | S | 8/2010 | Lown | |
| D620,807 | S | 8/2010 | Wang Treadway | |
| D621,220 | S | 8/2010 | Lown | |
| D646,920 | S | 10/2011 | Sheppard | |
| D647,243 | S | 10/2011 | Kong | |
| D650,696 | S | 12/2011 | Peden, III | |
| D661,939 | S | 6/2012 | Kern | |
| D664,202 | S | 7/2012 | Shu | |
| D743,488 | S | 11/2015 | Jun | |
| D755,059 | S | 5/2016 | Prada | |
| D789,148 | S | 6/2017 | Hornung | |
| D795,074 | S | 8/2017 | Staab | |
| D857,510 | S | 8/2019 | Maquita Nakano | |
| D865,440 | S | 11/2019 | Lowette | |
| D878,875 | S | 3/2020 | Nagao | |
| D887,764 | S | 6/2020 | Henkel | |
| D899,943 | S | 10/2020 | Lo | |
| D904,197 | S | 12/2020 | Sanghavi | |
| D909,665 | S | 2/2021 | Volodarsky | |
| 2012/0111345 | A1 * | 5/2012 | Sweitzer | A24F 1/30 131/173 |
| 2020/0095016 | A1 * | 3/2020 | Kehlenbeck | B65D 11/04 |
| 2020/0375246 | A1 | 12/2020 | LeNoir | |

OTHER PUBLICATIONS

Internet posting, "Session Corp. Will Do Business in California as Session Goods", (retrieved from the Internet on Nov. 4, 2022); https://ca.ltddir.com/companies/session-corp-which-will-do-business-in-california-as-session-goods/. (Year: 2022).*

Session Goods Water Pipe, Oct. 28, 2018 [online] [retrieved Sep. 30, 2020], Available from Internet, 7 pages, URL: https://web.archive.org/web/20181028000841/https://uncrate.com/session-goods-water-pipe/.

* cited by examiner

Front/Side Section

WATER PIPE

CROSS-REFERENCE TO RELATED APPLICATIONS

This application claims benefit of priority to U.S. Provisional Patent Application No. 62/828,886, filed Apr. 3, 2019, the aforementioned application being incorporated by reference in its entirety.

FIELD OF INVENTION

Examples pertain to a water pipe.

BACKGROUND

A water pipe can be utilized to combust consumable material, such as tobacco. Water in the water pipe cools and filters out smoke produced from the combusted consumable material.

Figure 1A:
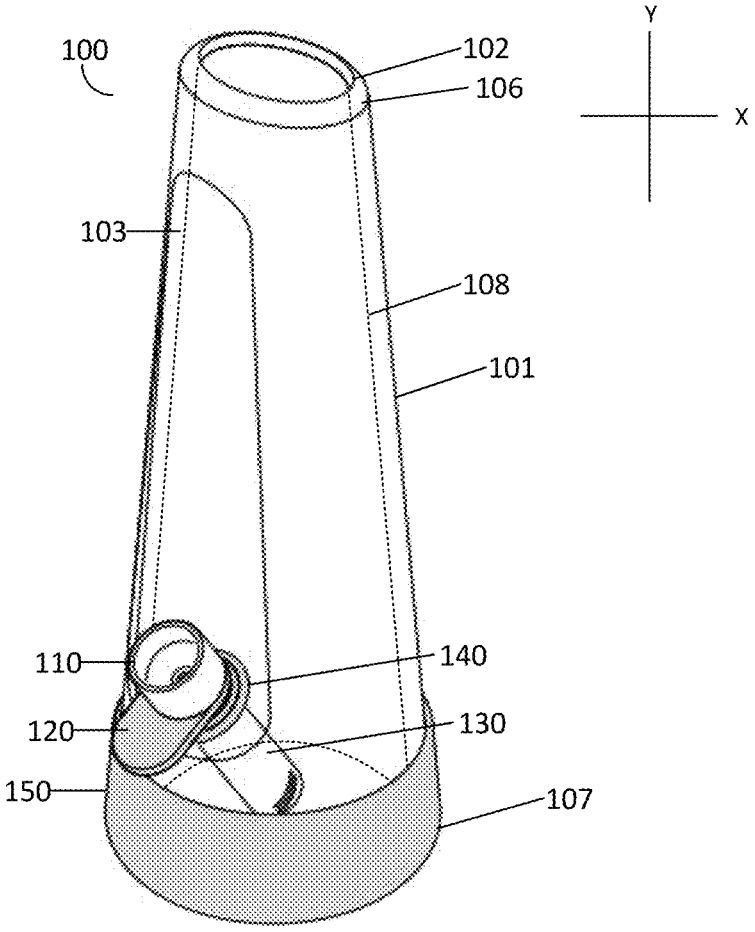
FIG. 1A illustrates an example water pipe.

Throughout the drawings, identical reference numbers designate similar, but not necessarily identical elements. The figures are not necessarily to scale, and the size of some parts may be exaggerated to more clearly illustrate the example shown. Moreover, the drawings provide examples and/or implementations consistent with the description. However, the description is not limited to the examples and/or implementations provided in the drawings.

DETAILED DESCRIPTION

Examples provide for a water pipe that includes a mouthpiece that is angled so that the user of the water pipe minimizes neck strain or a risk of spilling or splashing water in the water pipe out of the mouthpiece. Typically, under conventional approaches, a mouthpiece of the water pipe is generally flat, so as to be substantially parallel to the underlying surface on which the water pipe rests. In such circumstances, a user may have to tilt their head at an uncomfortable angle to engage the mouthpiece or tilt the water pipe at an angle that may cause water in the water pipe to spill or to splash onto or into the mouth of the user through the mouthpiece.

Additionally, examples provide for a body of a water pipe to include an indentation that is shaped and dimensioned to receive a user's fingers to enable the user to hold or grip the water pipe. In contrast, conventional water pipes generally have featureless or smooth bodies which are more prone to slippage by the user during use or when moving the conventional water pipe.

Moreover, examples provide for a bowl of a water pipe to include a tab formed from a heat resistant material. The tab can prevent heat from being absorbed while consumable material in the bowl is heated. Additionally, the tab can enable a user to pick up the bowl and not get burned. A bowl of a conventional water pipe generally does not include a tab that is made out of a heat resistant material. Generally, a bowl of a conventional water pipe has a component formed out of the bowl that is made out of a material that has low heat resistance. As such, shortly after a consumable material in the bowl has been heated, a user trying to pick up the bowl of the conventional water pipe may end up getting burned.

Still further, examples provide for a water pipe to include a protective sleeve that is dimensioned to fit a bottom end section of the water pipe. The protective sleeve may be formed out of a heat resistance material to prevent heat from being transferred from consumable material being combusted in a bowl of the water pipe to the bottom end section of the water pipe. That way, shortly after the consumable material is being combusted, the user may hold the protective sleeve that is fitted around the bottom end section of the water pipe without getting burned. The sleeve addresses a problem found in many conventional water pipes-that is that shortly after the consumable material is combusted, the heat from the bowl transfers to the body of the conventional water pipe, and this in turn can cause the user to burn themselves if they make direct contact with the water pipe body.

In various examples, the protective sleeve provides protection to the bottom of the water pipe. This reduces risk of the water pipe being damaged when inadvertently dropped, bumped or mishandled.

WATER PIPE DESCRIPTION

Figure 1B:
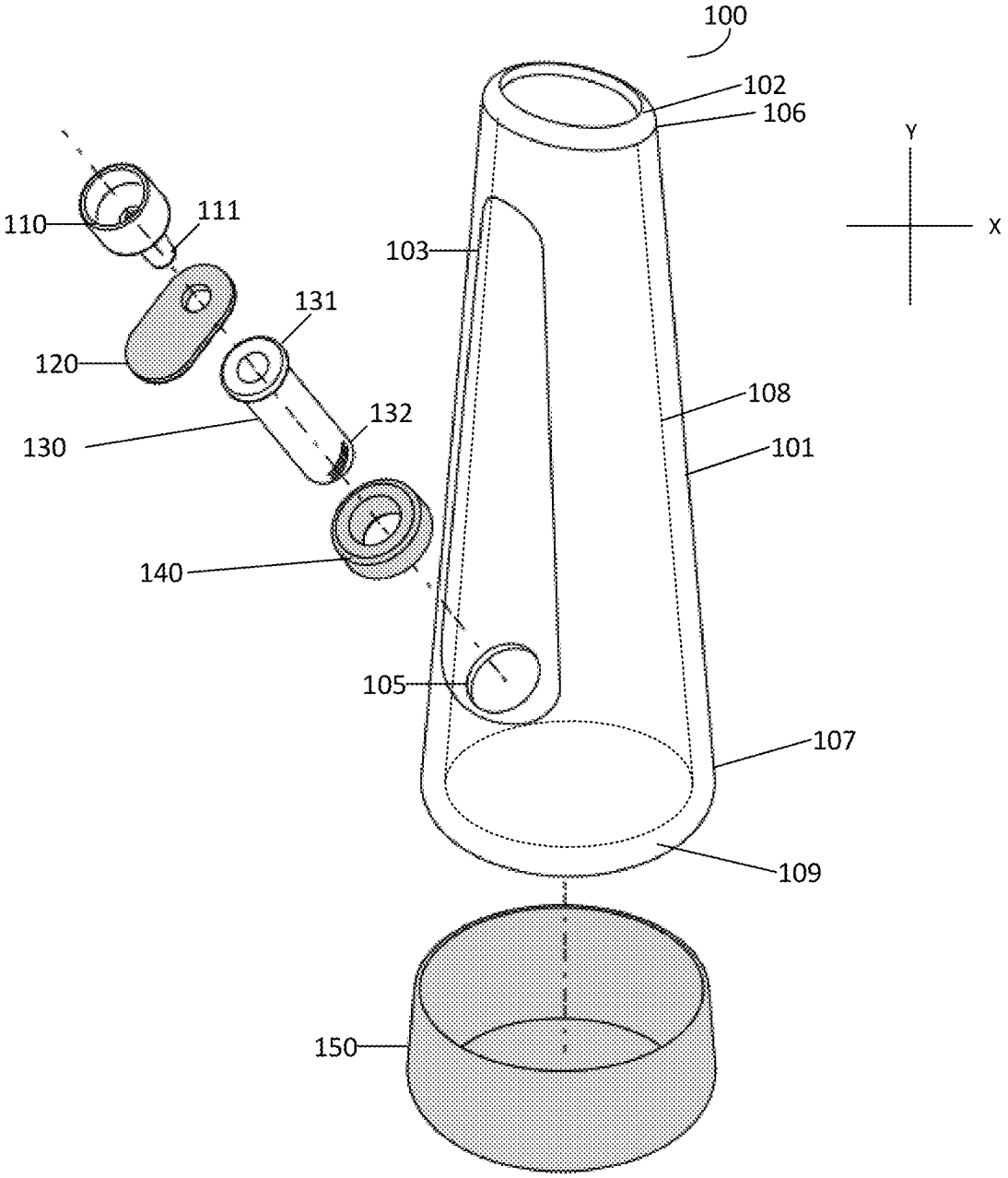
FIG. 1B illustrates an exploded view of the example water pipe of FIG. 1A.

With reference to FIG. 1A and FIG. 1B, an example water pipe 100 includes a body 101, a bowl 110, a tab 120, a down-stem 130, a grommet 140 and a protective sleeve 150. Body 101 can be formed from various types of materials, such as glass (e.g., borosilicate glass), ceramic or polymeric material (e.g., clear polyurethane).

The body 101 has a thickness that defines an opening or mouthpiece 102 at top end section 106. A well 108 extends from the mouthpiece 102 to the bottom end section 107. In various examples, mouthpiece 102 is acute with respect to the vertical axis (Y). For example, the mouthpiece 102 may be angled at 15 degrees relative to the Y-axis. The acute formation of the mouthpiece facilitates use for the user, causing less neck strain on the part of the user as compared to a conventional water pipe that has a mouthpiece that is generally flat or parallel to the flat surface that the conventional water pipe is resting on. Additionally, the risk of spilling or splashing water in water pipe 100 out of mouthpiece 102 is reduced because the user does not have to tilt water pipe 100 as much as a conventional water pipe when the user engages the mouthpiece 102.

In some examples, the body 101 can gradually taper from top end section 106 to bottom end section 107, such that a diameter of mouthpiece 102 is smaller than the diameter of base 109 at the bottom end section 107. As an addition or variation, body 101 can include indent 103. Indent 103 can be a recess formed from the body of 101. Moreover, indent 103 can extend from top end section 106 to bottom end section 107. In some examples, indent 103 can taper. In such examples, the tapering of indent 103 can be parallel to the tapering of body 101. In various examples, indent 103 can be dimension for a user's fingers. That way the user can have a better hold or grip on water pipe 100.

In other examples, the body 101 can be cylindrical, such that a diameter of mouthpiece 102 is smaller than the diameter of base 109 at the bottom end section 107. Additionally, in such examples, indent 103 can be a rectangular recess formed from the body of 101.

Figure 2A:
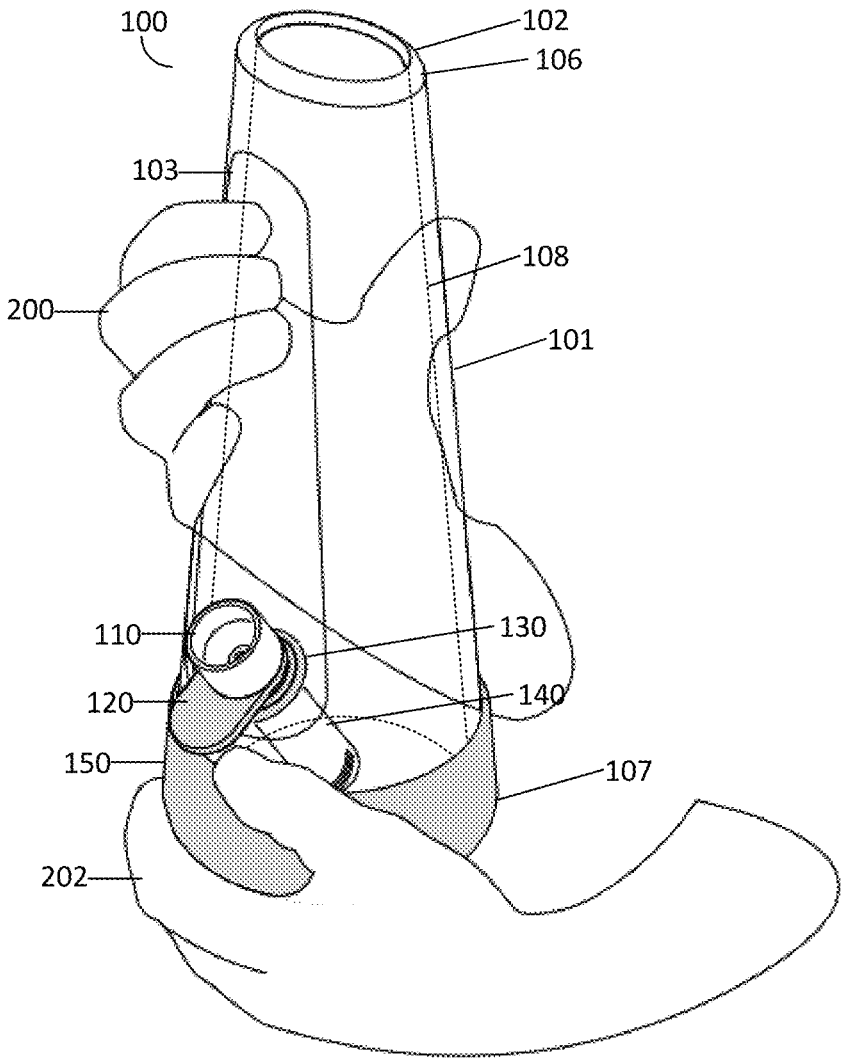
FIG. 2A illustrates an example diagram of how a user may hold the example water pipe of FIG. 1A using the indent.
Figure 2B:
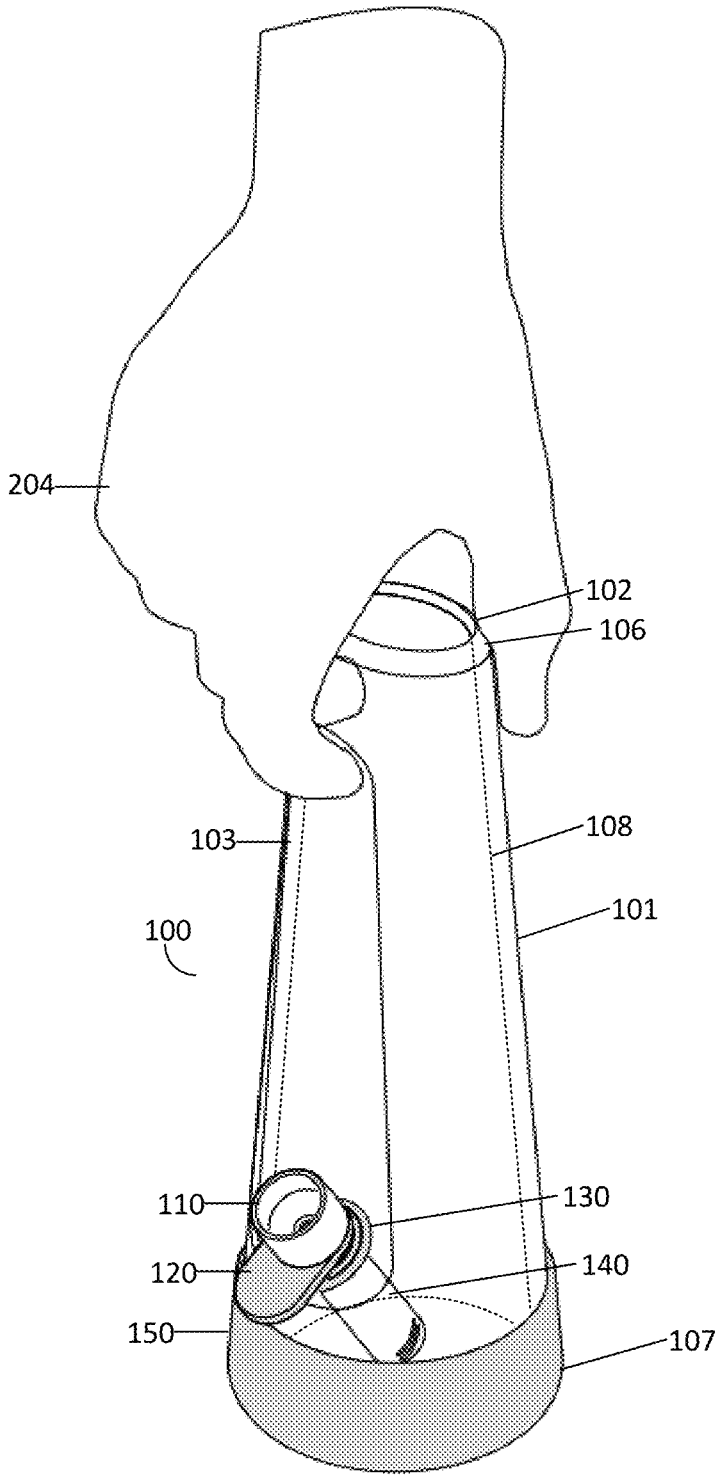
FIG. 2B illustrates another example diagram of how a user may hold onto the example water pipe of FIG. 1A.
Figure 3A:
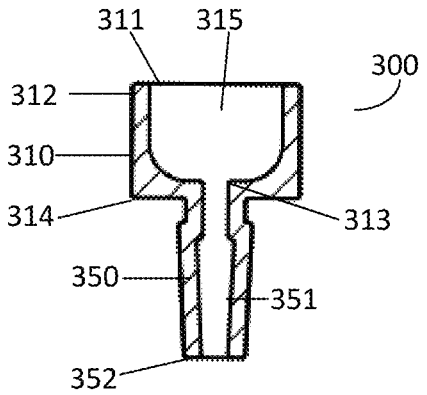
FIG. 3A illustrates a cross-sectional view of an example bowl.
Figure 3B:
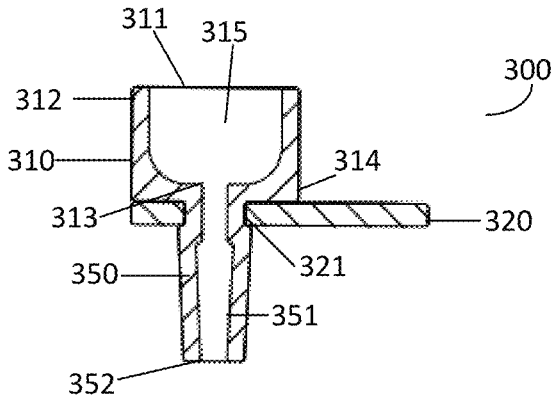
FIG. 3B illustrates a cross-sectional view of the example bowl of FIG. 3A with a tab attachment.
Figure 3C:
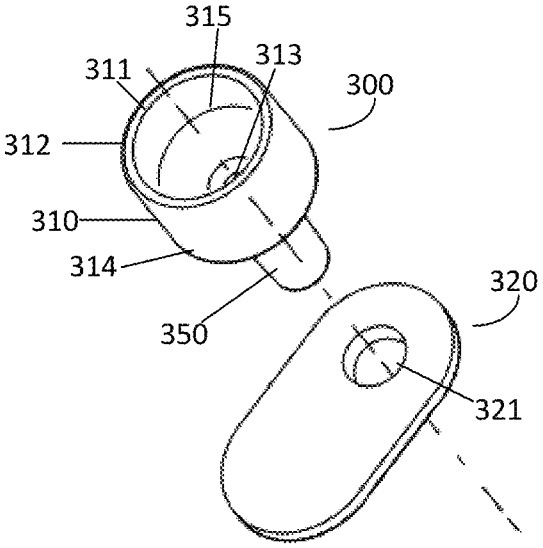
FIG. 3C illustrates a front-top view of the example bowl of FIG. 3A.
Figure 3D:
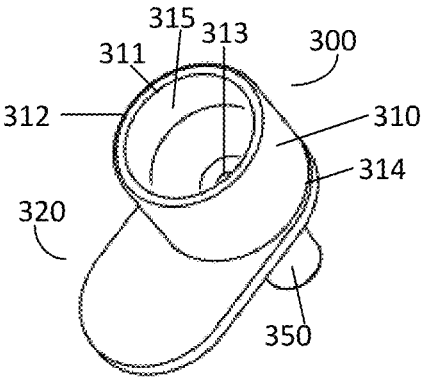
FIG. 3D illustrates a front-top view of the example bowl of FIG. 3B.

FIG. 2A illustrates how a user may hold onto the example water pipe of FIG. 1A. The recess formed on the side portion of indent 103 can form a shelving structure on the side portion of indent 103 to provide a grip for the fingers of user's right hand 200 (or left hand). That way, the user can have a secure hold on water pipe 100 while the user is using or about to use water pipe 100. In another example, FIG. 2B illustrates another example diagram of how a user may hold onto the example water pipe of FIG. 1A. The recess formed on the top portion of indent 103 can form a shelving structure on the top portion of indent 103 to provide another grip for the fingers of user's right hand 204 (or left hand). That way, the user can hold onto top end section 106 more securely when moving water pipe 100.

Water pipe 100 can include bowl 110 with bowl stem 111. In some examples, bowl 110 can be removable. Additionally, bowl 110 can be an attachment where consumable material, such as tobacco, can be combusted. In such examples, bowl stem 111 of bowl 110 can be connected to down-stem 130, and smoke produced from the combusted consumable material can travel to well 108 through down-stem 130. In other examples, bowl 110 can include bowl stem 111 that incorporates the length of down-stem 130. That way, smoke produced from combusting material in bowl 110 can reach the water in well 108 at the bottom end section 107 without down-stem 130. In various examples, bowl 110 with bowl stem 111 can be formed out of various materials, such as metal, ceramic or silicone. In some examples, bowl 110 and bowl stem 111 can be formed from glass, such as borosilicate glass.

FIGS. 3A-3D illustrate an example bowl, according to one or more examples. Bowl 300 can include bowl section 310 and bowl stem 350. Bowl section 310 can have a thickness that defines top opening 311 at top end section 312 and well opening 313 at base 314, with well 315 that extends from top opening 311 to well opening 313. Bowl stem 350 can extend from base 314 and include bowl stem opening 352, with conduit 351 extending from well opening 313 to bowl stem opening 252. In some examples, well 315 can include angular corners. In other examples well 315 can include rounded corners or be conical-like, to prevent uneven combusting of consumable materials in well 115. In various example, bowl section 310 can be wider or have a wider diameter than the diameter of bowl stem 350. In other examples, bowl section 310 can be no wider than the width of an indent of a water pipe, such as indent 103.

In some examples, bowl 300 can include tab 320. Tab 320 can be a removable attachment with bowl hole 321. Bowl hole 321 can be dimensioned to fit bowl stem 350. In examples where bowl section 310 is wider or has a wider diameter than the diameter of bowl stem 350, tab 320 can enable a user to lift bowl 300 without the user physically touching bowl section 310.

In various examples, tab 320 can be formed from a heat resistant material, such as silicone or rubber. That way, tab 320 can prevent heat from being absorbed while a consumable material in well 315 is being combusted. As such, the user can pick up bowl 300 with tab 320, and not get burned, shortly after the consumable material in well 315 has been combusted.

Down-stem 130 can include a top or first end section 131 and a bottom or second end section 132. First end section 131 and second end section 132 can both have an opening with a conduit extending from first end section 131 and second end section 132. In various examples, down-stem 130 can be formed out of various materials, such as ceramic or silicone. In some examples, down-stem 130 can be formed from glass, such as borosilicate glass.

In some examples, down-stem 130 can be inserted into water pipe 100 through a down-stem opening 105. In such examples, down-stem opening 105 can be located at the bottom portion of indent 103 and dimensioned to fit down-stem 130. Additionally, in some examples, a recess formed on the bottom portion of indent 103 can be angled so that the opening of second end section 132, when inserted into down-stem opening 105, is facing the bottom surface of well 108. That way, when enough water is in well 108 and down-stem 130 is inserted into down-stem opening 105, the portion of down-stem 130 that includes the opening of second end section 132 can be submerged in the water.

Figure 4A:
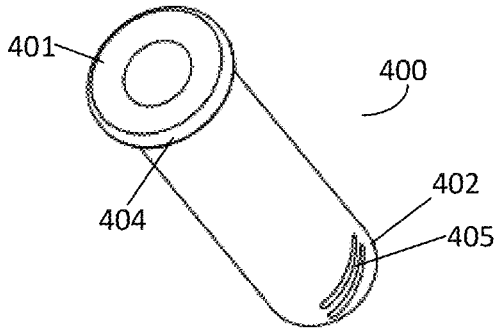
FIG. 4A illustrates a front-top view of an example down-stem.
Figure 4B:
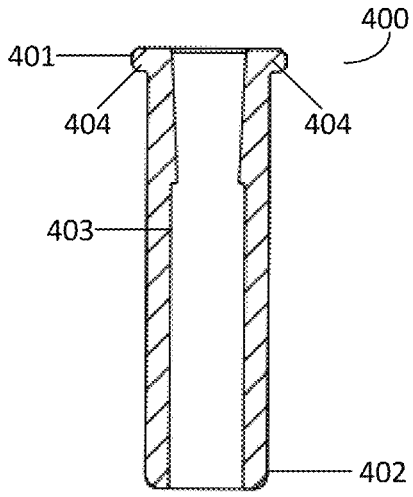
FIG. 4B illustrates a cross-sectional view of the example down-stem of FIG. 4A.

FIGS. 4A and 4B illustrate an example down-stem, according to one or more examples. As illustrated in FIG. 4A, down-stem 400 can have a thickness that defines a first opening at first end section 401 and a second opening at second end section 402, with conduit 403 extending from the first opening to the second opening. Additionally, first end section 401 can include lip 404, such as a protruding edge. In various examples, the protruding edge of lip 404 prevents down-stem 400 from passing through a down-stem opening of a water pipe, such as down-stem opening 105, when inserted. In such examples, the protruding edge of lip 404 can secure down-stem 400 on a surface of a water pipe when down-stem 400 is inserted into the down-stem opening. As an addition or variation, the second end section 402 can include one or more grooves 405 to enable better diffusion of smoke into water in a well (e.g., well 108) produced from combusting consumable materials in a bowl, such as bowl 110. That way, the smoke is better filtered through the water in the well of the water pipe. In such examples, the one or more grooves 405 can be formed into the surface of conduit 403.

In various examples, a portion of conduit 403 at first end section 401 can be dimensioned to fit a bowl stem, such as bowl stem 111 of bowl 110. In such examples, the portion of conduit 403 that is dimensioned to fit a bowl stem may be dimensioned differently than the remaining portions of conduit 403. For example, a bowl stem, such as bowl stem 111 may be tapered and conical-like. In such an example, as illustrated in FIG. 4B, the portion of conduit 403 dimensioned to fit a tapered or conically shaped bowl stem can also be conical-like and dimensioned to fit the tapered shape of the bowl stem. Additionally, the remaining portions of conduit 403 may remain cylindrical.

In some examples, a surface of conduit 403 can have a ground-glass finish, a smooth-glass finish or a combination thereof. In examples where the surface of conduit 403 has both a smooth-glass finish and a ground-glass finish, the surface of the portion of conduit 403 that is dimensioned to fit a bowl stem, such as bowl stem 111, can have a ground-glass finish, while the remaining portions of the conduit 403 can have a smooth-glass finish. In such examples, the bowl stem (e.g., bowl stem 111) may also have a ground glass finish on the exterior surface of the bowl stem. That way, when the bowl stem is inserted through the first opening of down-stem 400 and into the portion of conduit 403 that is dimensioned to fit the bowl stem, there is a tighter seal than if both the finish of the exterior of the bowl stem and the portion of conduit 403 that is dimensioned to fit the bowl stem have a smooth-glass finish.

Figure 5A:
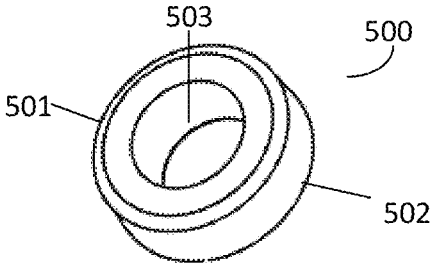
FIG. 5A illustrates a front-top view of an example grommet.
Figure 5B:
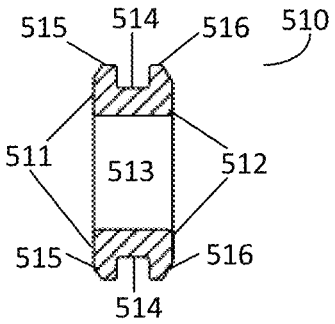
FIG. 5B illustrates a cross-sectional view of another example grommet.

In various examples, water pipe 100 can include grommet 140. Grommet 140 can protect and reduce the risk of down-stem 130 of being damaged, such as cracks, fractures or complete breaks, when being inserted or removed from down-stem opening 105. In such examples, grommet 140 can be dimensioned to line the edge of the down-stem opening 105. FIGS. 5A and 5B illustrate an example grommet, similar to grommet 140. As illustrated FIG. 5A, grommet 500 can have a thickness that defines a first opening at first end section 501 and a second opening at second end section 502, with conduit 503 extending from the first opening to the second opening. Additionally, conduit 503 can be dimensioned to fit a down-stem, such as down-stem 130.

In other examples, grommet 140 can have protruding edges so that down-stem 130 does not make direct contact with a surface of a water pipe (e.g., water pipe 100) when inserted into the grommet 140. FIG. 5B illustrates an example grommet with protruding edges. Similar to grommet 500, grommet 510 can have a thickness that defines a first opening at first end section 511 and a second opening at second end section 512, with conduit 513 extending from the first opening to the second opening. Conduit 513 can be dimensioned to fit a down-stem, such as down-stem 130. Additionally, grommet 510 can include a recess at mid-section 514 to form first protruding edge 515 at first end section 511 and second protruding edge 516 at second end section 512. The mid-section 514 can be dimensioned to fit and line the edge of an opening of a water pipe, such as down-stem opening 105. That way, a down-stem inserted into grommet 510, such as down-stem 130, can sit on grommet 510 and not directly on the surface of the water pipe, such as water pipe 100. In such examples, grommet 510 can be formed from a heat resistant material, such as silicone or rubber, to prevent heat to be transferred from the down-stem (e.g., down-stem 130) to the rest of the body of the water pipe (e.g., body 101).

Figure 6A:
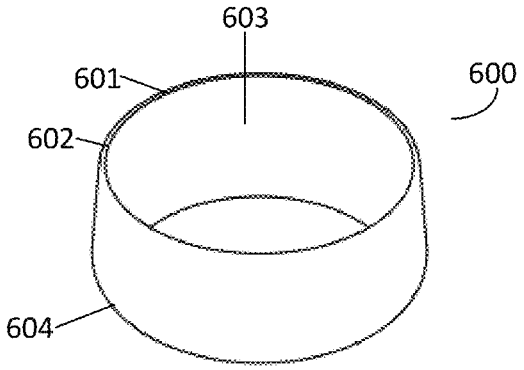
FIG. 6A illustrates a front-top view of an example protective sleeve.
Figure 6B:
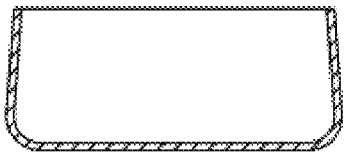
FIG. 6B illustrates a cross-sectional view of the example protective sleeve of FIG. 6A.

Additional protective measures can be included with water pipe 100, such as protective sleeve 150. FIGS. 6A and 6B illustrate an example protective sleeve, similar to protective sleeve 150. Protective sleeve 600 can have a thickness that defines opening 601 at upper portion 602 with well 603 that extends from opening 601 to base portion 604. Well 603 can be dimensioned to fit bottom end section of a body of a water pipe, such as body 101. In some examples, a height of protective sleeve 600 when a body of a water pipe is inserted into well 603, can extend to a bottom portion of an indent of the body, such as indent 103. In other examples, a height of protective sleeve 600 when a body of a water pipe is inserted into well 603, can vary between a bottom portion of an indent of the body, such as indent 103, and the base of the body, such as base 109. In various examples, the height of protective sleeve 600 when a body of a water pipe is inserted into well 603, can indicate the maximum amount of liquid, such as water, that can be poured into the well of the body, such as body 101.

Protective sleeve 600 can be formed out of heat resistant material to prevent heat from being transferred from consumable material being combusted in a bowl, such as bowl 110, to a bottom portion of a water pipe, such as water pipe 100. That way, shortly after the consumable has been or is being combusted, a user may hold the water pipe with protective sleeve 600 and not get burned. FIG. 2A, illustrates how a user can hold onto the bottom of a water pipe, such as water pipe 100, while using the water pipe. In other examples, protective sleeve 600 can be formed out of materials such as, industrial felt or leather.

As an addition or alternative, protective sleeve 600 can be formed out of material that can also provide protection to the bottom of the water pipe. For example, protective sleeve 600 can be formed out of materials such as, silicone or rubber. Such material can reduce a risk of the water pipe, such as water pipe 100, being damaged when inadvertently dropped, bumped or mishandled.

Although specific examples have been illustrated and described herein, it will be appreciated by those of ordinary skill in the art that a variety of alternate and/or equivalent implementations may be substituted for the specific examples shown and described without departing from the scope of the disclosure. This application is intended to cover any adaptations or variations of the specific examples discussed herein.

What is claimed is:

1. A water pipe comprising:
- a removable bowl including a bowl stem;
- a tab including a hole dimensioned to fit a diameter of the bowl stem; and
- a body including:
  - a top end section;
  - a bottom end section terminating at a base;
  - an opening at the top end section;
  - a well extending from the opening to the bottom end section; and
  - an indent extending from the top end section to the bottom end section,
- the indent including a top portion and a bottom portion, the bottom portion including an indent opening dimensioned to receive the bowl stem and the top portion including a recess formed from the body to provide a shelving structure for one or more fingers of a user to securely grip the water pipe.

2. The water pipe of claim 1, wherein the body gradually tapers from the top end section to the bottom end section.

3. The water pipe of claim 1, wherein at least a portion of a surface of the bowl stem has a ground-glass finish.

4. The water pipe of claim 1, wherein the tab is formed from a heat resistant material.

5. The water pipe of claim 1, wherein the bowl is formed from borosilicate glass.

6. The water pipe of claim 1, further comprising:
- a down-stem, the down-stem including:
  - a first end section with a first opening;
  - a second end section with a second opening; and
  - a conduit extending from the first opening to the second opening.

7. The water pipe of claim 6,
- wherein a portion of the conduit at the first end section of the down-stem is dimensioned to receive the bowl stem.

8. The water pipe of claim 7, wherein a surface of the conduit of the down-stem has a ground-glass finish, a smooth-glass finish or a combination thereof.

9. The water pipe of claim 6, wherein the first end section of the down-stem includes a protruding edge.

10. The water pipe of claim 1, further comprising:

a grommet dimensioned to line an edge of the indent opening.

11. The water pipe of claim 10, wherein the grommet includes:

a first end section with a first opening;

a second end section with a second opening; and a conduit extending from the first opening to the second opening.

12. The water pipe of claim 11, wherein the grommet is formed from a heat resistant material.

13. The water pipe of claim 1, wherein the indent gradually tapers from the top end section to the bottom end section and wherein a diameter of the opening is smaller than a diameter of the base.

14. The water pipe of claim 1, further comprising:

a protective sleeve dimensioned to fit the bottom end section of the body, the protective sleeve being formed from a heat resistant material.

15. The water pipe of claim 1, wherein the bottom end section has a cross section that lies on a first plane, wherein the opening has a cross section that lies on a second plane that is acutely angled relative to the first plane, and wherein the acute angle formation of the opening is adapted to reduce neck strain and a risk of fluid within the well from being spilled when a user engages with the opening.

16. A water pipe comprising:

a removable bowl including a bowl stem;

a tab including a hole dimensioned to fit a diameter of the bowl stem; and a body including:

a top end section;

a bottom end section terminating at a base;

an opening at the top end section; and an indent extending from the top end section to the bottom end section, the indent including a top portion and a bottom portion, the bottom portion including an indent opening dimensioned to receive the bowl stem and the top portion including a recess formed from the body to provide a shelving structure for one or more fingers of a user to securely grip the water pipe;

wherein both the body and the indent gradually taper from the top end section to the bottom end section.

17. The water pipe of claim 16, wherein the body further includes:

a well extending from the opening to the bottom end section.

18. The water pipe of claim 16, wherein the bottom end section has a cross section that lies on a first plane, wherein the opening has a cross section that lies on a second plane that is acutely angled relative to the first plane.

19. A water pipe comprising:

a removable bowl including a bowl stem;

a tab including a hole dimensioned to fit a diameter of the bowl stem; and a body including:

a top end section;

a bottom end section terminating at a base and having a cross section that lies on a first plane;

an opening at the top end section, the opening having a cross section that lies on a second plane that is acutely angled relative to the first plane;

a well extending from the opening to the bottom end section; and an indent extending from the top end section to the bottom end section, the indent including a top portion and bottom portion, the bottom portion including an indent opening and dimensioned to receive the bowl stem and the top portion including a recess formed from the body to provide a shelving structure for one or more fingers of a user to securely grip the water pipe.

20. The water pipe of claim 19, wherein the indent gradually tapers from the top end section to the bottom end section.

* * * * *